US005848921A

United States Patent [19]

Mochida

[11] Patent Number: 5,848,921

[45] Date of Patent: Dec. 15, 1998

[54] POWER DRIVEN VESSEL HAVING PROPELLING POWER MOUNTING APPARATUS

[76] Inventor: Kenji Mochida, Hamamatsu-Shi, Shizuoka-Ken, 430, Japan

[21] Appl. No.: 810,856

[22] Filed: Mar. 4, 1997

[51] Int. Cl.[6] ..... B63H 5/12

[52] U.S. Cl. ..... 440/53; 440/61; 440/54

[58] Field of Search ..... 440/53, 54, 61–63, 440/55–60, 900; 114/284

[56] References Cited

U.S. PATENT DOCUMENTS

| | | | |
|---|---|---|---|
| Re. 24,451 | 4/1958 | Daniles | 440/53 |
| 1,574,977 | 3/1926 | Johnson et al. | 440/53 |
| 2,747,536 | 5/1956 | Russell | 440/61 |
| 3,469,558 | 9/1969 | Puretic | 440/53 |
| 4,000,712 | 1/1977 | Erikson et al. | 114/284 |
| 4,534,738 | 8/1985 | McKnight | 440/53 |
| 4,713,028 | 12/1987 | Duff | 440/61 |
| 5,254,023 | 10/1993 | Kobayashi | 440/53 |
| 5,465,678 | 11/1995 | Ekman | 440/53 |

FOREIGN PATENT DOCUMENTS 410400 3/1925 Germany .

*Primary Examiner*—Ed L. Swinehart
*Attorney, Agent, or Firm*—Muramatsu & Associates

[57] ABSTRACT

A power driven vessel is able to accommodate various types of power drive. The power driven vessel includes a vessel main body, power drive having an engine and a driving unit, an attachment member for mounting the power drive thereon, an insert recess portion formed within the rear portion of vessel main body, and a bottom plate disposed on the insert recess portion. The attachment member is movable between an upper position and a lower position in the vessel, and is directly placed on the bottom plate and inserted in the insert recess portion when the attachment member is held in the lower position.

11 Claims, 3 Drawing Sheets

POWER DRIVEN VESSEL HAVING PROPELLING POWER MOUNTING APPARATUS

BACKGROUND OF THE INVENTION

The present invention relates to an apparatus for mounting means for propelling a power driven vessel. More particularly, the present invention in concerned with more popularization of propelling means for a motor boat or the like.

Conventional apparatus of the foregoing type are normally classified into the following types. (1) First type is such that an engine is mounted in the vessel main body so as to allow a propeller to be rotated by a propeller shaft extending through the vessel main body. In other words, the first type is such that a so-called inboard motor is installed in the vessel main body. (2) Second type is such that an engine is installed in the vessel gain body so as to allow the propeller to be rotated by a driving unit arranged outside of the vessel main body. In other words, the second type is such that a so-called inboard/outdriving motor is installed in the vessel main body. (3) Third type is such that the propeller is rotated by an engine and a driving unit arranged outside of the vessel main body. In other words, the third type is such that the propeller is rotated by an engine and a driving unit arranged outside of the vessel main body. (4) Fourth type is such that water is ejected from the vessel main body arranged in the vessel main body.

However, the conventional apparatuses as mentioned above have the following drawbacks. (1) Since the methods of using the propelling means are entirely different from each other (since the inboard motor and the inboard/outdriving motor are used while they are immovably held in the vessel main body and the outboard motor is used while it is detachably arranged in the vessel main body), the structure of the vessel main body, in which the engine and the driving unit are arranged, becomes difficult from each other by itself. Consequently, it is very difficult that different types of propelling means are interchangeably used in the same vessel main body. (2) With respect to a vessel for which the conventional inboard motor and the conventional inboard/outdriving motor are used, since they can not completely be tilted up from the water surface because of their own structure, the driving unit is easily corroded and many sea-living objects such as an attorn shell or the like readily adhere to the outer surface of the vessel main body. (3) With respect to a vessel for which the conventional inboard motor or the conventional inboard/outdriving motor is used, since it takes any manhours because of its own structure for allowing the engine and the driving unit to be detached from the vessel main body, it is usually used while it is held on the vessel main body even in the case that the engine and the driving unit are not used for a long period of time. Consequently, an occurrence of rusting is readily recognized on the outer surface of the vessel main body, causing the engine and the driving unit to incorrectly operate. In the case that a maintenance service is to be performed by an operator or operators specializing in maintaining the engine and the driving unit, it is required that the operator or operators in charge of a maintenance service should walk on his or their feet to the location where the vessel is immovably anchored with the result that it often takes many manhours for allowing the operator or operators to complete his or their maintenance service.

The present invention has been made in consideration of the aforementioned background.

An object of the present invention is to provide an apparatus for mounting means for propelling a power driven vessel without any drawbacks inherent to the conventional apparatus.

Other object of the present invention is to provide an apparatus of the foregoing type which assures that conventional several vehicle propelling means can selectively be used.

Another object of the present invention is to provide en apparatus of the foregoing type which assures that the vessel propelling means can be tilted up in the case that the inboard motor is not used or the inboard/outdriving motor is not used.

SUMMARY OF THE INVENTION

The objects as mentioned above are achieved by providing an apparatus for mounting means for propelling a power driven vessel by propelling means, the apparatus including a vessel main body and propelling means comprising an engine and a driving unit, wherein the apparatus of the foregoing type is characterized in that the propelling means is arranged on an attachment member, an insert recess portion is formed on the rear surface of the vessel main body, and the attachment member can be placed on the bottom plate and is held in the state that the attachment member can be inserted in the insert recess portion.

In addition, the attaching member received in the insert recess portion can turnably be displaced relative to the vessel main body by suitable driving means so as to turn about the foremost upper end of the attaching member.

Additionally, an inboard motor, an inboard/outdriving motor, an outboard motor and water jet propelling means can be used as propelling means.

Since the apparatus of the present invention is constructed in the above-described manner, different types of propelling means are interchangeably used in the same vessel main body merely by exchanging the attachment member with another one, provided that the attachment member having the inboard motor arranged therein, the attachment member having the inboard/outdriving motor arranged therein, and the attachment member having water jet propelling means arranged therein are preliminarily prepared, whereby the range of use of the single vessel body can be enlarged. In addition, in the case that the propelling means is disposed for the attachment member, the engine and the driving unit are preliminarily arranged in the set state. Thus, when the engine and the driving unit are installed in the vessel main body, the number of manhours required for arranging the propelling means can be reduced. Consequently, arrangement of the propelling means in the vessel body is achieved easily.

In addition, when the attached member disposed in the insert recess portion can be turned with the foremost upper end of the attachment member used as a center for turning movement of the attachment member so that the attachment member can improvably be held, the inboard motor or the inboard/outdriving motor can be tilted up from the water surface. Thus, corrosion of the driving unit can be prevented, and moreover, adhesion of sea-living objects or the like to the outer surface of the vessel main body can be prevented too. As a result, a maintenance service for the power driven vessel can be performed easily.

Further, since the propelling means can easily be detached from and attached to the vehicle main body, the engine and the driving unit can easily be detached from the vessel main body. Thus, in the case that the engine and the driving unit are not used for a long time, an occurrence of rusting can be prevented, and in the case that a maintenance service is performed for the motor and the driving unit, since the engine and the driving unit detached from the vessel main body can be transported to the working site, each maintenance operation can be achieved easily.

Additionally, since the propelling means can be attached to and detached from the vehicle main body, the engine and the driving unit can easily be dismounted from the vehicle main body. Consequently, it is recommendable that the engine and driving unit are dismounted from the vehicle in the case that the engine and the driving unit are not used for long period of time. Thus, stability of the vehicle main body can be improved, and an occurrence of sinking of the vehicle body can reliably be prevented during the anchoring of the vehicle main body.

Other object and advantages of the present invention will be apparent from reading of the following description on the preferred embodiments of the present invention.

BRIEF DESCRIPTION OF THE ACCOMPANYING DRAWINGS

DESCRIPTION OF PREFERRED EMBODIMENTS

The present invention will be described below in detail with reference to the accompanying drawings which illustrate preferred embodiments of the present invention.

Figure 1:
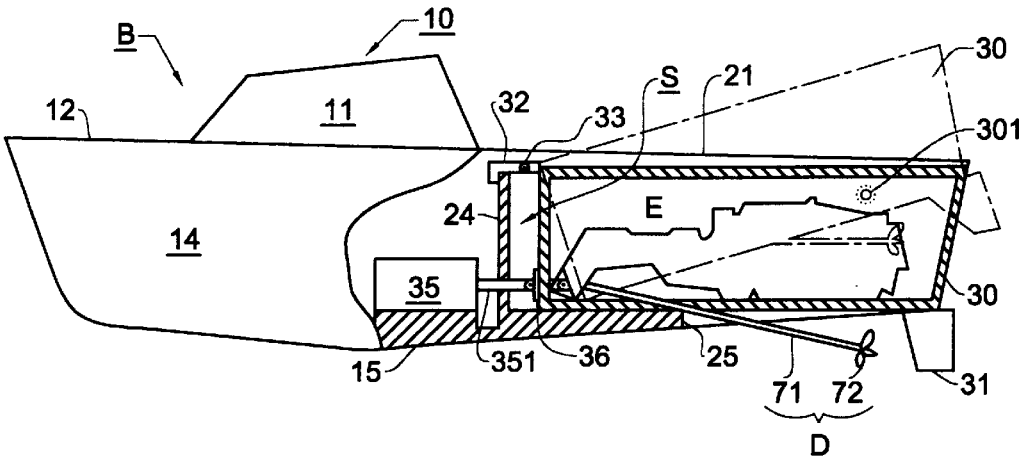
FIG. 1 is a partially exploded sectional view of a vessel according to a first embodiment of the present invention.
Figure 2:
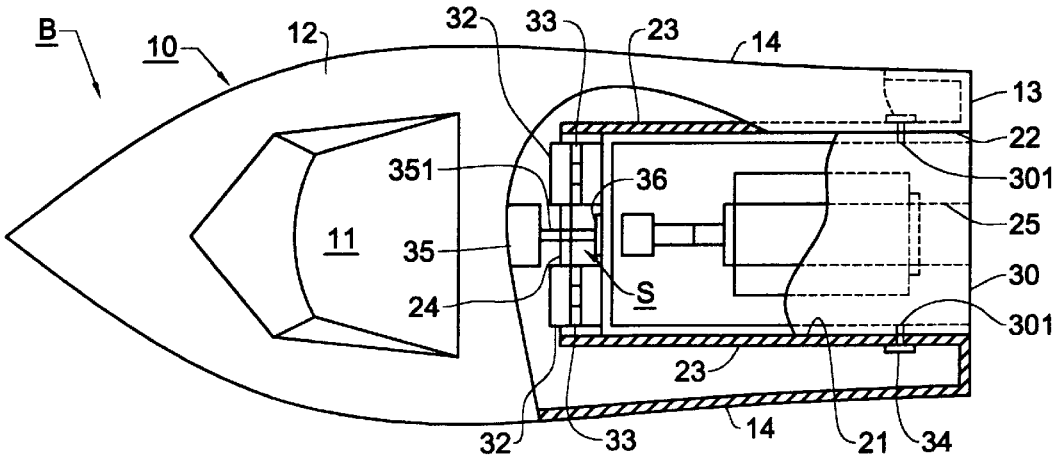
FIG. 2 is a plan view of the vessel shown in FIG. 1.

FIG. 1 and FIG. 2 illustrate a first embodiment of the present invention, respectively.

In the drawings, reference numeral 10 designates a main body of a motor boat B (corresponding to "power driven vessel" in the present invention), reference numeral 11 designates a steering seat, reference numeral 12 designates a deck of the boat, reference numeral 13 designates a transom board (corresponding to "rear surface of the boat" in the present invention), reference numeral 14 designates a gunwale plate of the boat, and reference numeral 15 designates a bottom plate of the boat. Each of the deck 12, the transom board 13, the gunwale plates 14 and the bottom plate 15 to integrally molded of a synthetic resin or a similar material.

Reference numeral 21 designates an upper opening portion which Is formed behind the rear and part of the deck 12. Reference numeral 22 designates a rear surface opening portion which is formed on the transom board 13. These opening portions 21 and 22 are connected to each other with the same width. Reference numeral 23 designates a side plate which stands upright on the bottom plate 15. The upper end edge of each side plate 23 is connected to and communicated with the side peripheral edge of the upper opening portion 21. Reference numeral 24 designates a center plate which stands upright on the bottom plate 15. This center plate 24 is connected to the side plates 23 while exhibiting a U-shaped configuration. An insert recess portion S of the present invention to defined by the center plate 24 and the side platen 23 and the bottom plate 15. In addition, reference numeral 25 designates a cutout which is formed on the bottom plate 15. The function of the cutout 25 will be described later.

Reference numeral 30 designates an attachment box (corresponding to "an attachment member" in the present invention). The attachment box 30 is detachably inserted in the insert portion S. A driving unit D including an engine E, a propeller shaft 71 and a propeller 72 in accommodated in the attachment box 30. In other words, a V drive type inboard engine assembly is accommodated in the attachment box 30 in the set state. Reference numeral 31 designates a rudder plate which is disposed at the rear and part of the attachment box 30. When the attachment box 30 is inserted in the insert portion S of the boat while it is placed on the bottom plate 15, the propeller shaft 71, the propeller 72, the rudder 31 and associated components can be projected outside of the main body 10 through the cutout 25. In addition, reference numeral 301 designated an engagement hole which is formed on the outside surface of the attachment box 30. The function of each engagement hole 301 will be described later.

Reference numeral 32 designates a hook-like locking member which is disposed at the upper and portion of the attachment box 30 via hinges 33. The attachment bar 30 is held on the upper end edge of the center plate 24 with the aid of the hook-like locking member 32. With this construction, the attachment box 30 can turnably be displaced in the vertical direction with the aid of the hinges 33.

References numeral 34 designates an engagement pin which is disposed on the slid plate 23 so as to move in the forward/rearward direction. The attachment box 30 can stably be held by inserting the engagement pins 34 into engagement holes 301 on the side surfaces of the attachment box 30.

Reference numeral 35 designates a piston cylinder mechanism which is arranged on the bottom plate 15. A piston rod 351 of the piston cylinder mechanism 35 extends through the center plate 24 in such a manner as to move in the forward/rearward direction, and the piston rod 351 is connected to a thrust plate 36 at the foremost and thereof via a crevice. With this construction, as the attachment box 30 is displaced to turn about the hinges 33 by actuation of the piston cylinder mechanism 35, the attachment box 30 can be tilted up (refer to the state as represented by phantom lines in the drawings). At this time, it is necessary that the engagement pins 34 are preliminarily withdrawn from the engagement holes 301. In addition, the piston cylinder mechanism 35 may be attached to any place, provided that the attachment box 30 is ready to turn, and the foregoing place should not be limited only to the place identified in this embodiment of the present invention. Besides the piston cylinder mechanism, any type of driving mechanism such as a gear mechanism having a motor used therefor or the like can be used.

Figure 3:
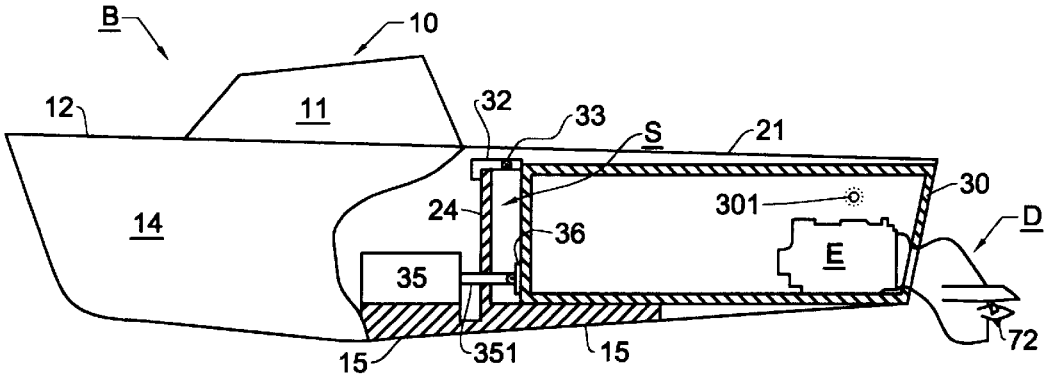
FIG. 3 is a partially exploded sectional view of a vessel according to a second embodiment of the present invention.

FIG. 3 is a partially exploded sectional view of a motor boat which is constructed in accordance with the second embodiment of the present invention.

Figure 4:
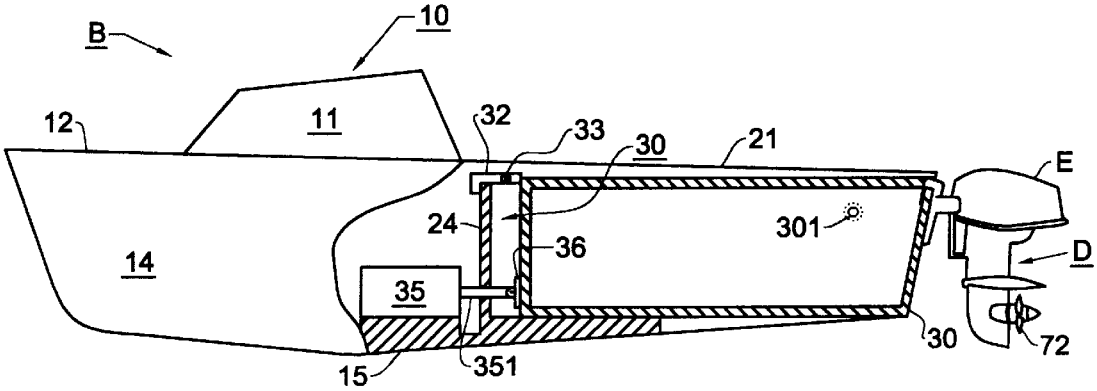
FIG. 4 is a partially exploded sectional view of a vessel according to a third embodiment of the present invention.

In this embodiment, an engine E is accommodated in an attachment box 30, and a driving unit D including a propeller 72 and associated components is attached to the rear surface of an attachment box 30. In other words, an apparatus of the type having the structure of an inboard/outdriving motor employed for the attachment box 30 is inserted in the insert recess portion S constructed in accordance with the first embodiment of the present invention, FIG. 4 to a partially exploded sectional view of a motor board which is constructed in accordance with a third embodiment or the present invention.

In this embodiment, an engine E and a driving unit D including a propeller 72 and associated components are arranged on the rear surface of an attachment box 30 in the set state. In other words, an apparatus of the type having the structure of an outboard motor employed for the attachment box 30 is inserted in the insert recess portion S constructed in accordance with the first embodiment of the present invention.

Figure 5:
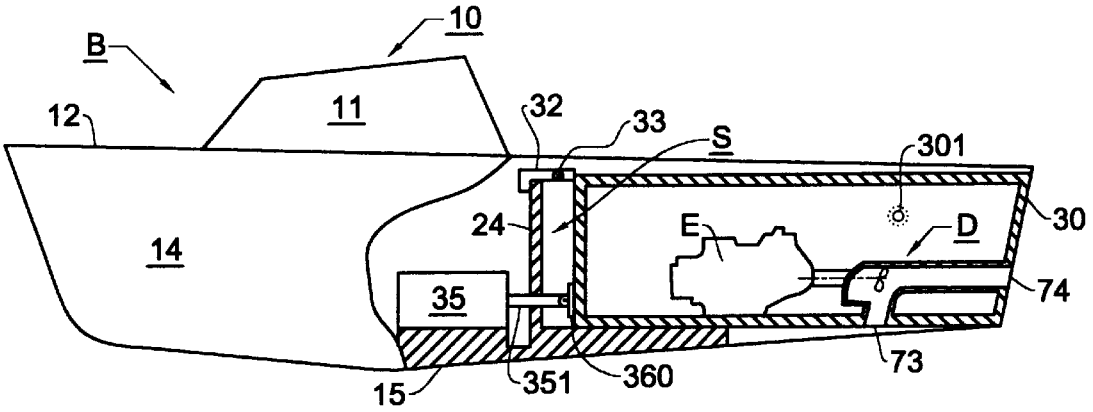
FIG. 5 is a partially exploded sectional view of a vessel according to a fourth embodiment of the present invention.

FIG. 5 is a partially exploded sectional view of a motor boat which in constructed in accordance with a fourth embodiment of the present invention. In this embodiment, an engine E and a water jet unit (a driving unit) D are accommodated in an attachment box 30 in the set state. In other words, an apparatus of the type having the structure of water jet propelling means employed for the attachment box 30 is inserted in the insert recess S constructed in accordance with the first embodiment of the present invention. In addition, reference numeral 73 designates a water suction port for the water jet unit (driving unit) D, and reference numeral 74 designates a water ejection port for the water jet unit D.

As is apparent from the above description, according to the present invention, the attachment box 30 constructed in accordance with the first to fourth embodiments can be attached to and detached from the insert recess portion S in the vessel main body 10. Of Course, it is obvious that the attachment box 30 constructed in the same embodiment of the present invention can exchangeably be attached and detached.

In addition, the attachment box 30 can be opened and disassembled for the purpose of performing a maintenance service.

What is claimed is:

1. A power driven vessel, comprising:

a vessel main body;

propelling means comprising an engine and a driving unit;

an attachment box for mounting said propelling means thereon; and an insert recess portion formed within the vessel main body at the rear portion thereof, said insert recess portion being defined by a center plate, side plates and a bottom plate thereby forming a substantially rectangular space;

wherein said attachment box is movable between an upper position and a lower position in the vessel, said attachment box being directly placed on said bottom plate and inserted in said insert recess portion when said attachment box being held in said lower position in a manner to snugly fit in said rectangular space of said insert recess portion without play, and at least a part of said attachment box being positioned above said insert recess portion when said attachment box being held in said upper position, and said propelling means is mounted on said attachment box separately from the vessel main body.

2. The power driven vessel as claimed in claim 1, wherein said propelling means is an inboard motor where an engine and a propeller driver are provided within the attachment box while a propeller is extended through the attachment box and vessel main body to the water.

3. The power driven vessel as claimed in claim 1, wherein said propelling means is an inboard/outdriving motor where an engine is provided within the attachment box while a propeller driver is provided outside of the attachment box.

4. The power driven vessel as claimed in claim 1, wherein said propelling means is an outboard motor where both an engine and a propeller driver are provided outside of the attachment box.

5. The power driven vessel as claimed in claim 1, wherein said propelling means is water jet propelling means which elects water for producing a driving force.

6. The power driven vessel as claimed in claim 1, wherein said attachment box can turnably be displaced relative to the vessel main body by suitable driving means so as to allow it to turn about the foremost upper end thereof and that said attachment box can immovably be held at a suitable position.

7. The power driven vessel as claimed in claim 6, wherein said propelling means is an inboard motor where an engine and a propeller driver are provided within the attachment box while a propeller is extended through the attachment box and vessel main body to the water.

8. The power driven vessel as claimed in claim 6, wherein said propelling means is an inboard/outdriving motor where an engine is provided within the attachment box while a propeller driver is provided outside of the attachment box.

9. The power driven vessel as claimed in claim 6, wherein said propelling means is water jet propelling means which elects water for producing a driving force.

10. The power driven vessel as claimed in claim 1, further including an attachment box driver for driving said attachment box between said upper position and said lower position.

11. The power driven vessel as claimed in claim 10, wherein said attachment box driver is a piston cylinder mechanism mounted on said bottom plate.

* * * * *